US008353178B2

(12) United States Patent
Kim et al.

(10) Patent No.: US 8,353,178 B2
(45) Date of Patent: Jan. 15, 2013

(54) ICE MAKING TRAY FOR REFRIGERATOR

(75) Inventors: Jin-ho Kim, Gwangju (KR); Young-gwi Park, Gwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 914 days.

(21) Appl. No.: 12/153,377

(22) Filed: May 16, 2008

(65) Prior Publication Data

US 2009/0145159 A1 Jun. 11, 2009

(30) Foreign Application Priority Data

Dec. 6, 2007 (KR) ..... 10-2007-0126277

(51) Int. Cl.

| | |
|---|---|
| ***A23G 9/00*** | (2006.01) |
| ***F25C 1/00*** | (2006.01) |
| ***F25C 1/22*** | (2006.01) |
| ***F25C 5/02*** | (2006.01) |

(52) U.S. Cl. ..... 62/345; 62/66; 62/71; 62/340

(58) Field of Classification Search ..... 62/66, 71, 62/340, 345

See application file for complete search history.

(56) References Cited

U.S. PATENT DOCUMENTS

| | | | | |
|---|---|---|---|---|
| 7,204,092 | B2 * | 4/2007 | Azcarate Castrellon et al. | 62/72 |
| 2002/0014087 | A1 * | 2/2002 | Kwon | 62/340 |
| 2006/0117786 | A1 * | 6/2006 | Lee et al. | 62/351 |

FOREIGN PATENT DOCUMENTS

| | | | |
|---|---|---|---|
| CN | 1573270 | A | 2/2005 |
| CN | 101082458 | A | 12/2007 |
| KR | 10-2005-0022067 | | 3/2005 |
| KR | 10-0565603 | | 3/2005 |
| KR | 673714 | * | 1/2007 |
| KR | 10-2007-0033514 | | 3/2007 |
| KR | 10-0705182 | * | 4/2007 |

OTHER PUBLICATIONS

Chinese Office Action dated Nov. 16, 2011 issued in corresponding Chinese Patent Application No. 200810173346.6.

Korean Office Action mailed Jul. 4, 2012 issued in corresponding Korean Patent Application No. 10-2007-0126277.

Chinese Office Action mailed May 11, 2012 issued in corresponding Chinese Patent Application No. 200810173346.6.

Korean Notice of Allowance issued Sep. 17, 2012 in corresponding Korean Patent Application No. 10-2007-0126277.

Chinese Office Action issued Nov. 26, 2012 in corresponding Chinese Patent Application No. 200810173346.6.

* cited by examiner

*Primary Examiner* — Mohammad Ali
*Assistant Examiner* — Daniel C Comings
(74) *Attorney, Agent, or Firm* — Staas & Halsey LLP

(57) ABSTRACT

An ice making housing which is mounted in a refrigerator door and forms an ice making chamber including an ice making tray which has a rotational shaft to be rotatably accommodated in the ice making housing, and an ice generating unit to freeze supplied water; an ice separating unit which is mounted in the ice making housing and separates ice cubes from the ice making tray; an overflow preventing member which is rotatably coupled to the ice making housing along a lengthwise direction of the ice making tray and prevents overflow of water accommodated in the ice making tray; and a driving unit which is provided in the ice making tray and the overflow preventing member and allows the overflow preventing member to reciprocate between an ice separating position separating ice cubes from the ice generating unit and a cover position covering the ice generating unit.

13 Claims, 14 Drawing Sheets

ICE MAKING TRAY FOR REFRIGERATOR

CROSS-REFERENCE TO RELATED APPLICATIONS

This application claims priority from Korean Patent Application No. 10-2007-0126277, filed on Dec. 6, 2007 in the Korean Intellectual Property Office, the disclosure of which is incorporated herein by reference.

BACKGROUND

1. Field

Apparatuses consistent with the present invention relate to a refrigerator, and more particularly, to a refrigerator which prevents overflow of water accommodated in an ice making tray mounted in a door.

2. Description of the Related Art

Generally, a refrigerator is a device which has a freezing compartment to store therein food at temperatures below the freezing point and a refrigerating compartment to store therein food at temperatures relatively higher than those of the freezing compartment. The freezing and refrigerating compartments are closed by a freezing compartment door and a refrigerating compartment door, respectively.

An ice making tray is installed in the freezing compartment or the freezing compartment door of the refrigerator to make ice cubes from supplied water. The ice making tray is installed in the freezing compartment door in the case of a side by side (SBS) refrigerator and a top mount freezer (TMF) refrigerator. Meanwhile, the ice making tray is installed in the refrigerating compartment door in the case of a bottom mount freezer (BMF) refrigerator.

The conventional ice making tray which is installed in the door includes an overflow preventing member. The overflow preventing member covers a lateral side of the ice making tray to thereby prevent water supplied to the ice making tray from overflowing to the outside by the opening and closing of the door.

However, the overflow preventing member which is installed in the conventional ice making tray contacts the ice making tray or an ice separating unit when ice cubes are separated from the ice making tray. Therefore, the ice cubes are not separated easily.

If used for a long term, the ice making tray is deformed by the contact with the overflow preventing member in the ice separation, which possibly lowers credibility of the product.

SUMMARY

Accordingly, it is an aspect of the present invention to provide a refrigerator which includes an overflow preventing member to prevent overflow of water from an ice making tray and to prevent cross interference between the overflow preventing member and the ice making tray in an ice separating operation.

Also, it is another aspect of the present invention to provide a refrigerator which includes an overflow preventing member to prevent cross interference between the overflow preventing member and an ice making tray in an ice separating operation and to prevent deformation of the ice making tray.

The foregoing and/or other aspects of the present invention can be achieved by providing a refrigerator which has a main body cabinet including a storage compartment, and a door coupled with the main body cabinet to open and close the storage compartment, the refrigerator including: an ice making housing which is mounted in the door and forms an ice making chamber; an ice making tray which has a rotational shaft to be rotatably accommodated in the ice making housing, and an ice generating unit to freeze supplied water; an ice separating unit which is mounted in the ice making housing and separates ice cubes from the ice making tray; an overflow preventing member which is rotatably coupled to the ice making housing along a lengthwise direction of the ice making tray and prevents overflow of water accommodated in the ice making tray; and a driving unit which is provided in the ice making tray and the overflow preventing member and allows the overflow preventing member to reciprocate between an ice separating position separating ice cubes from the ice generating unit and a cover position covering the ice generating unit.

The overflow preventing member may be rotatably coupled with the ice making housing to be in parallel with a rotational axis of the ice making tray.

The driving unit may rotate the ice making tray and the overflow preventing member in opposite directions.

The driving unit may include a driving gear which is provided in the rotational axis of the ice making tray and rotates by the operation of the ice separating unit, and a driven gear which is provided in a rotational axis of the overflow preventing member and engaged with the driving gear to rotate together.

The ice making tray may be plurally stacked on the ice making housing and the overflow preventing member may correspond to the plurality of ice making trays.

The driving unit may further include an ice separating gear which is rotatably coupled with the ice separating unit and disposed at predetermined intervals from the plurality of driving gears provided in the plurality of ice making trays, and a connecting gear, a first side of which is engaged with the plurality of driving gears and a second side of which is engaged with the ice separating gear to move together with the rotation of the ice separating gear and rotate the plurality of driving gears.

The connecting gear may reciprocate in a transverse direction of the rotational axis of the ice making tray by the rotation of the ice separating gear.

The driving unit may further include an ice separating gear which is coupled with the ice separating unit to be engaged with the driving gear and moves together with the driving gear to rotate the driving gear by the ice separating unit.

The ice separating unit may be coupled with the driving gear and supplies rotational force to the driving gear.

The driving unit may include a driving pulley which is provided in the rotational axis of the ice making tray and rotates by the operation of the ice separating unit; a driven pulley which is rotatably provided in a rotational axis of the overflow preventing member; and a belt which crossedly connects the driving pulley and the driven pulley and rotates the driving and driven pulleys.

The refrigerator may further include an elastic member which is provided in the ice separating unit and supplies elastic force to move the overflow preventing member from the ice separating position to the cover position.

The ice separating unit may include a lever member which is shaped like a bar.

The ice separating unit may include a motor.

Additional aspects and/or advantages will be set forth in part in the description which follows and, in part, will be apparent from the description, or may be learned by practice of the invention.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF THE EMBODIMENTS

Figure 1:
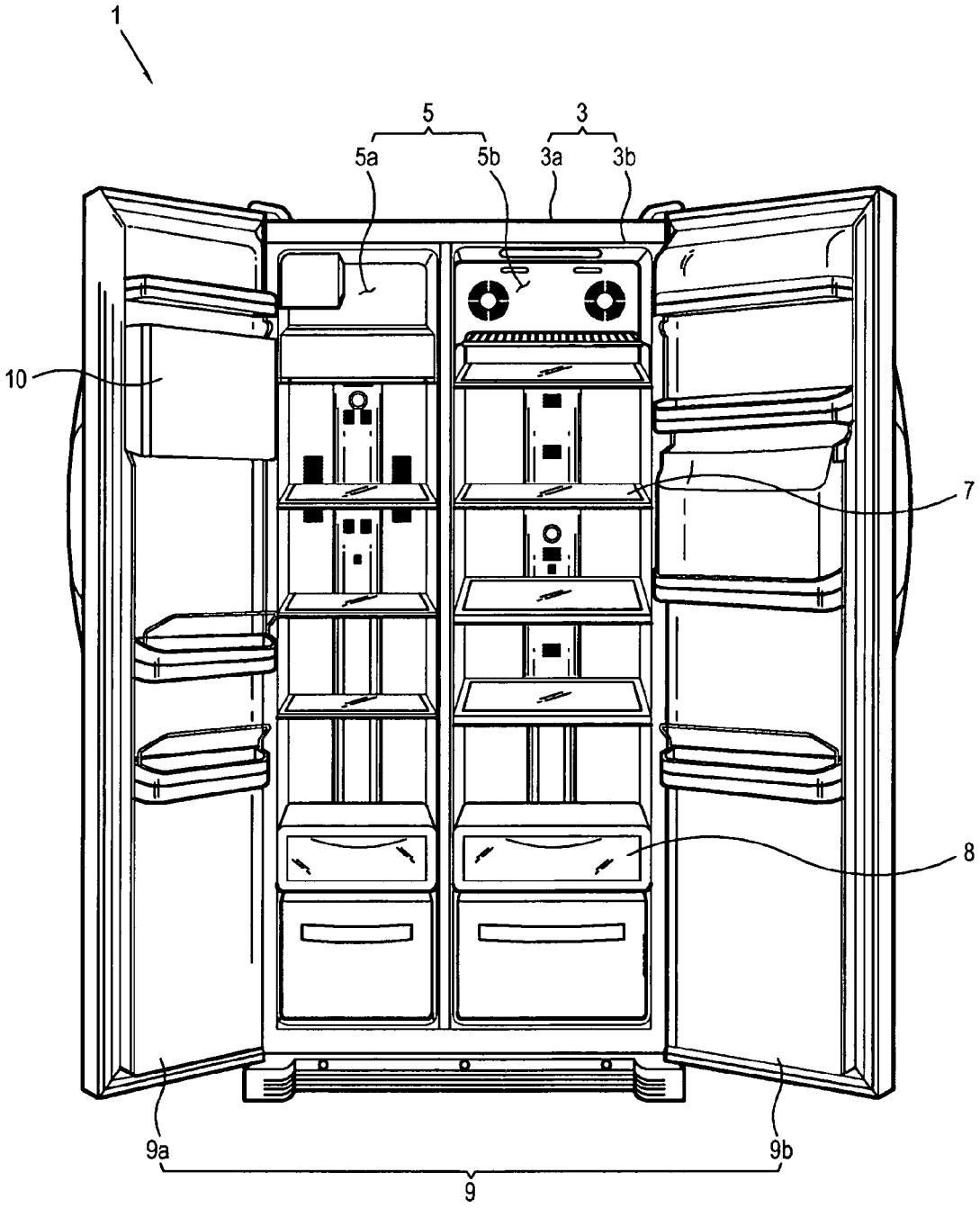
FIG. 1 is a perspective view of a refrigerator according to the present invention.

Reference will now be made in detail to the embodiments of the present invention, examples of which are illustrated in the accompanying drawings, wherein like reference numerals refer to like elements throughout. The embodiments are described below so as to explain the present invention by referring to the figures.

Exemplary embodiments according to the present invention are mounted in a freezing compartment door of a side by side (SBS) refrigerator, and may be mounted in a freezing compartment door of a top mount freezer (TMF) refrigerator or in a refrigerating compartment door of a bottom mount freezer (BMF) refrigerator.

Figure 2:
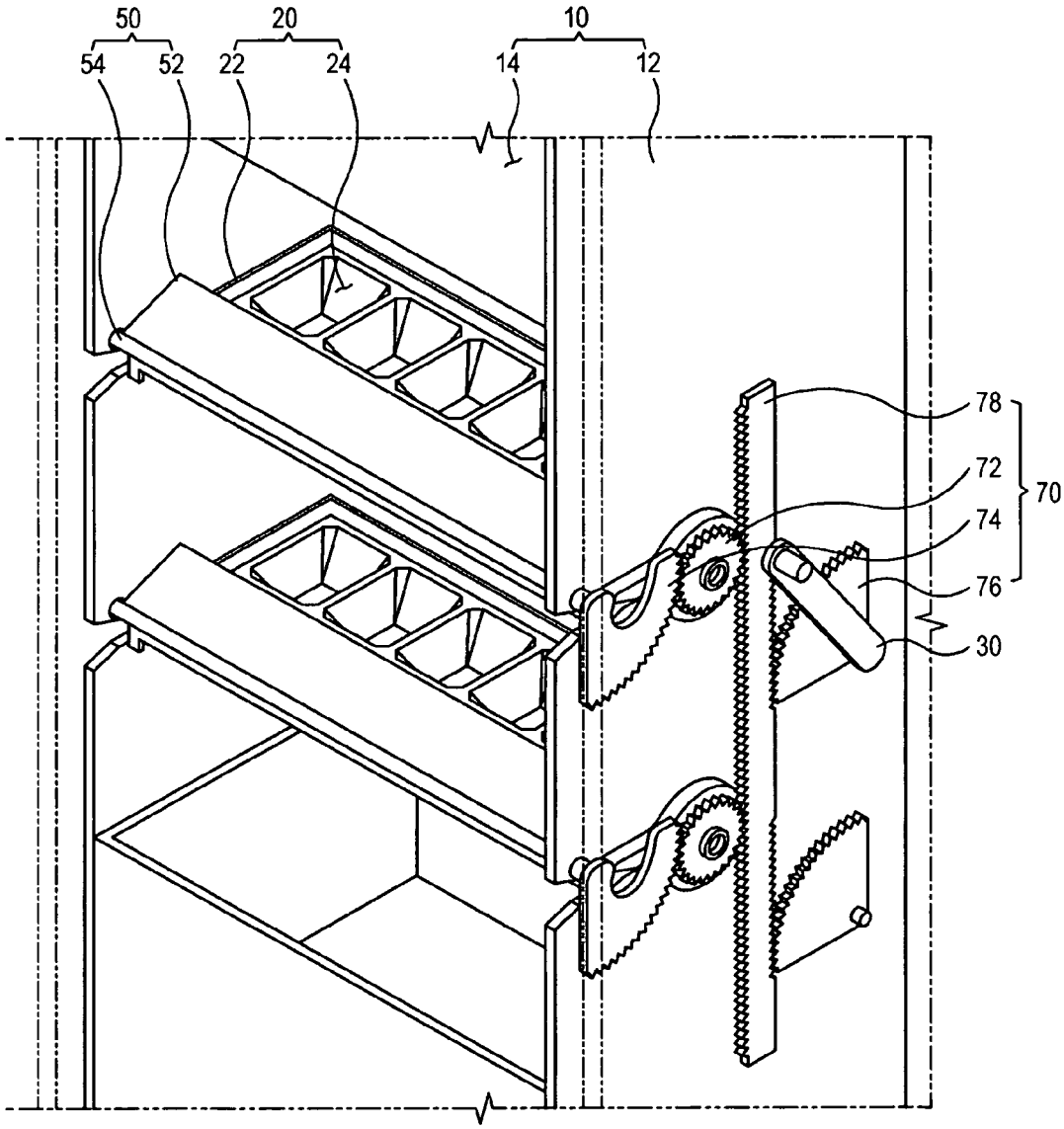
FIG. 2 is a coupling perspective view of a driving unit according to a first exemplary embodiment of the present invention.
Figure 3:
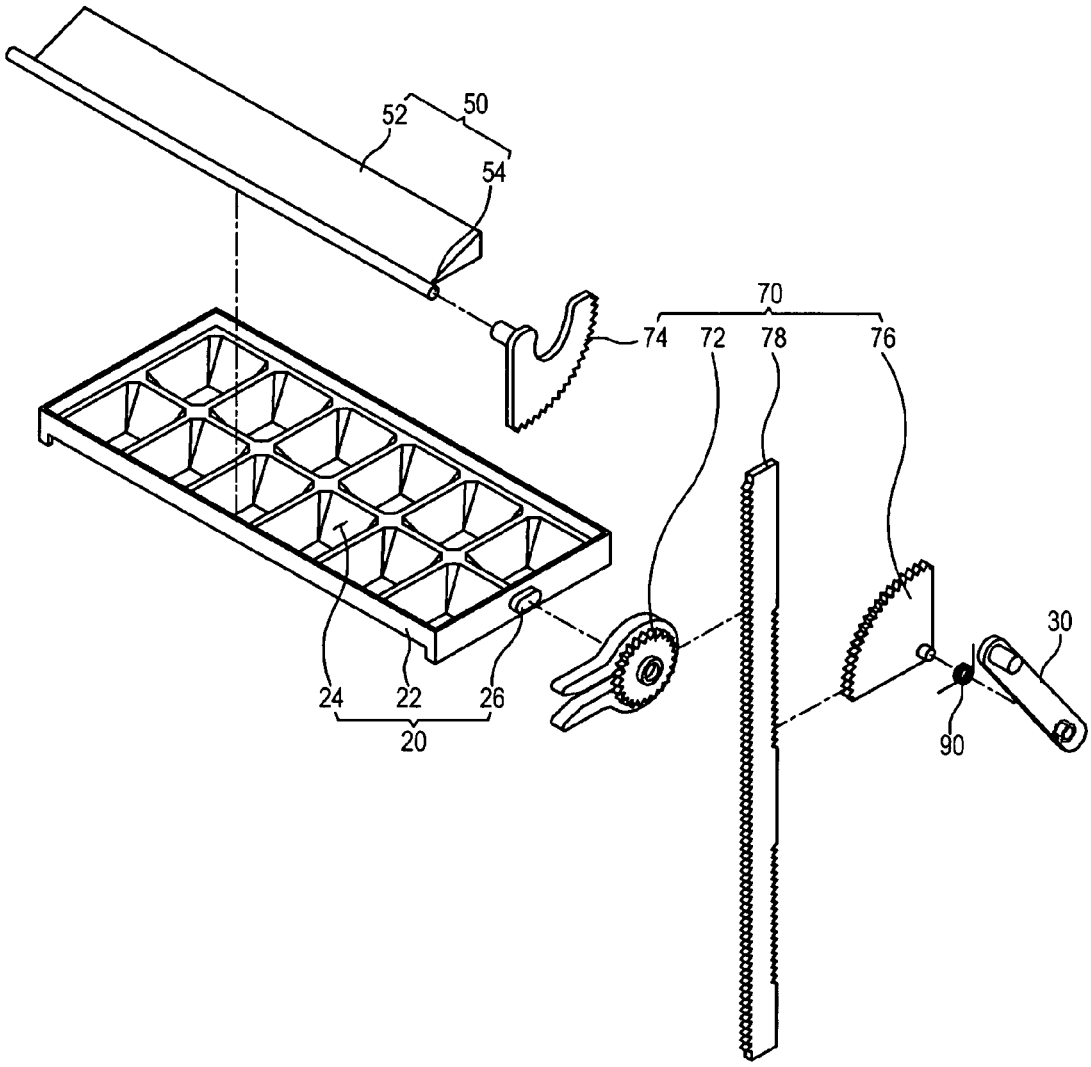
FIG. 3 is an exploded perspective view of the driving unit in FIG. 2.
Figure 4A:
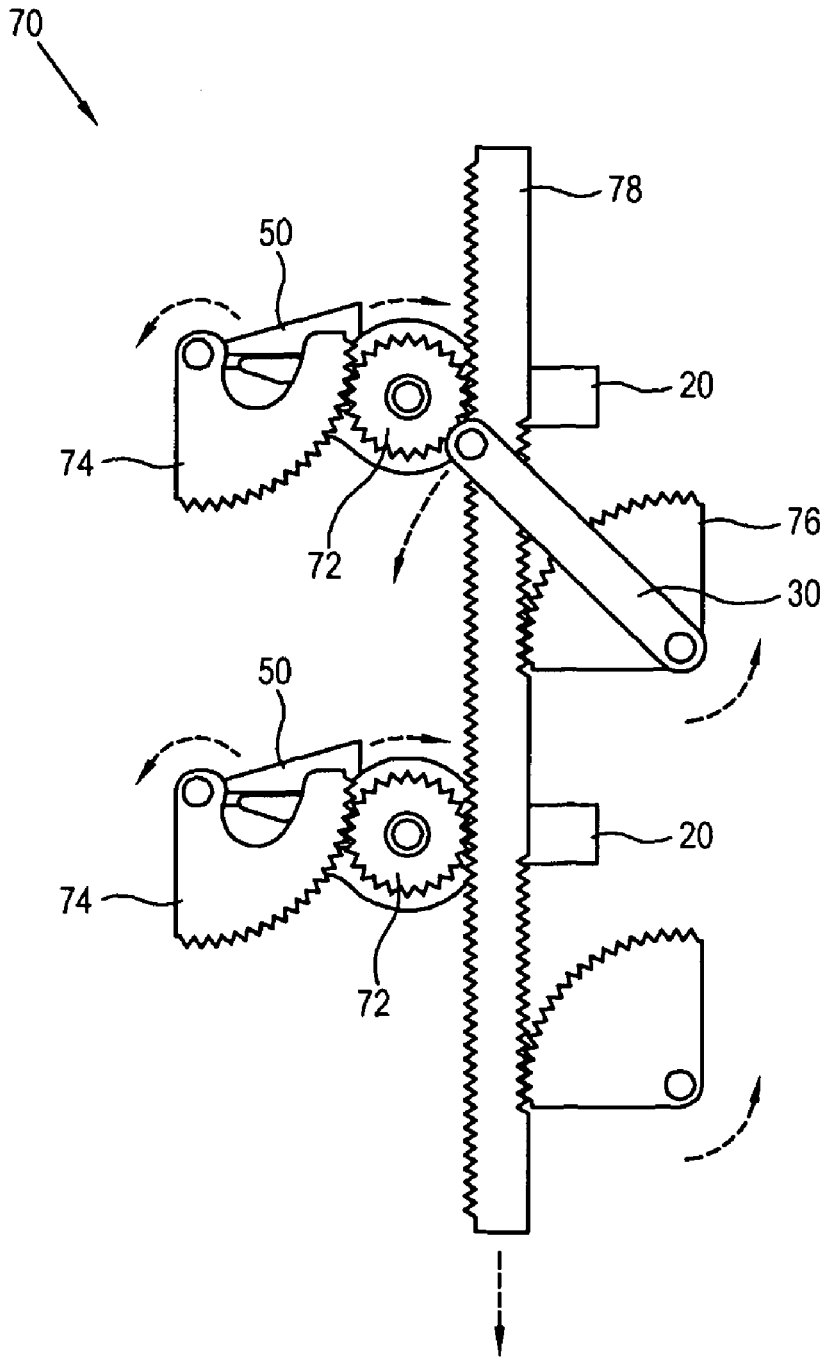
FIG. 4A is a first operational view of the driving unit according to the first exemplary embodiment of the present invention.
Figure 4B:
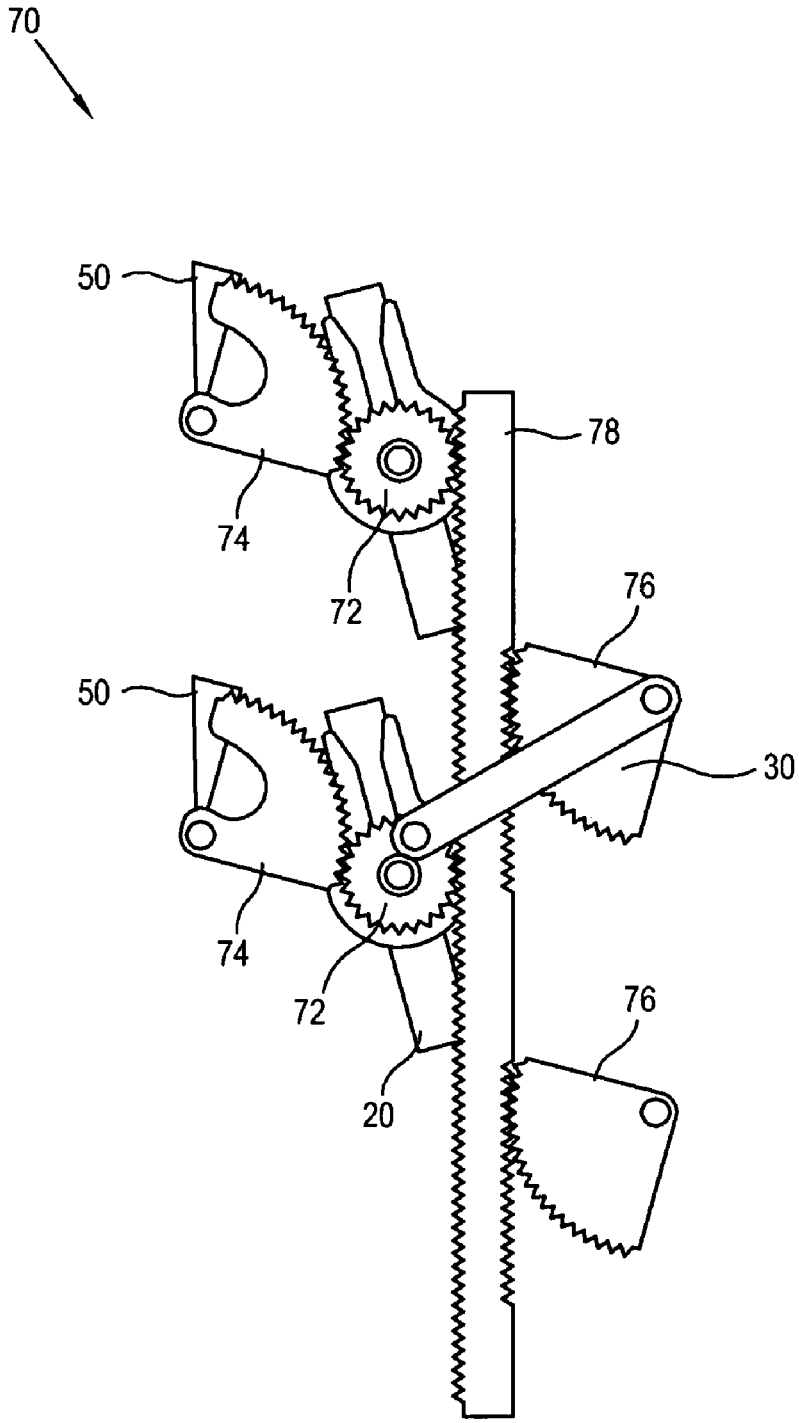
FIG. 4B is a second operational view of the driving unit according to the first exemplary embodiment of the present invention.

As shown in FIGS. 1 and 2, a refrigerator 1 according to the present invention includes a main body cabinet 3, a storage compartment 5 formed in the main body cabinet 3, a door 9 opening and closing the storage compartment 5, an ice making housing 10 mounted in the door 9, an ice making tray 20 accommodated in the ice making housing 10 and generating ice cubes, an ice separating unit 30 mounted in the ice making housing 10 and separating ice cubes from the ice making tray 20, an overflow preventing member 50 rotatably coupled with the ice making housing 10, and a driving unit 70 provided in the ice making tray 20 and the overflow preventing member 50 to rotate them.

The main body cabinet 3 forms an external appearance of the refrigerator 1, and the storage compartment 5 therein to store food. The main body cabinet 3 includes an external casing 3*a* forming an external appearance and an internal casing 3*b* disposed within the external casing 3*a*. Here, a foaming agent is injected between the external casing 3*a* and the internal casing 3*b* of the main body cabinet 3 to insulate the storage compartment 5. A compressor (not shown), a condenser (not shown), a capillary tube (or an expansion valve, not shown) and an evaporator (not shown) are accommodated in the main body cabinet 3 to from a cooling cycle.

The storage compartment 5 is formed in the main body cabinet 3 by the internal casing 3*b*. According to an exemplary embodiment of the present invention, the storage compartment 5 is divided into a freezing compartment 5*a* and a refrigerating compartment 5*b* by a wall. A shelf 7 and a storage chamber 8 are disposed in the storage compartment 5. The shelf 7 divides food accommodating space of the storage compartment 5 into a plurality of spaces and the storage chamber 8 is disposed below the shelf 7 and has the divided food accommodating space.

According to an exemplary embodiment of the present invention, the door 9 is rotatably coupled to opposite sides of the main body cabinet 3 by a hinge. The door 9 includes a freezing compartment door 9*a* to open and close the freezing compartment 5*a*, and a refrigerating compartment door 9*b* disposed in parallel with the freezing compartment door 9*a* to open and close the refrigerating compartment 5*b*. According to an exemplary embodiment of the present invention, the ice making housing 10 is mounted in a rear side of the freezing compartment door 9*a* to accommodate the ice making tray 20 and an ice accommodator (not shown).

As shown in FIGS. 2 to 4B, the ice making housing 10 is mounted in the rear side of the freezing compartment door 9*a*. The ice making housing 10 forms an ice making chamber 14 which receives cool air and accommodates therein the ice making tray 20. That is, the ice making housing 10 includes a housing main body 12 forming an external appearance and the ice making chamber 14 formed by the housing main body 12. The ice accommodator is provided in the ice making housing 10 to store therein ice cubes separated from the ice making tray 20. The overflow preventing member 50 and the driving unit 70 are also mounted in the ice making housing 10.

The ice making tray 20 is rotatably accommodated in the ice making housing 10. According to an exemplary embodiment of the present invention, the ice cubes generated by the ice making tray 20 are separated by twisting the ice making tray 20. Thus, the ice making tray 20 preferably includes a plastic material to be deformed sufficiently. Preferably, the ice making tray 20 also includes a highly conductive material to freeze accommodated water by cool air supplied by the ice making chamber 14. The ice making tray 20 includes a tray main body 22 having an ice generating unit 24 to accommodate water therein, and rotational shafts 26 provided in opposite sides of the tray main body 22.

The tray main body 22 includes a plurality of ice generating units 24 which is depressed from a plate surface to generate a plurality of ice cubes. The tray main body 22 torsion-rotates by rotational force supplied by the rotational shafts 26 formed in opposite sides thereof.

The rotational shafts 26 are provided in opposite sides of the tray main body 22. The tray main body 22 is rotatably coupled to the ice making housing 10 by a pair of rotational shafts 26. A first side of the pair of rotational shafts 26 is connected with the driving unit 70 and receives rotational force therefrom. A second side of the pair of rotational shafts 26 is coupled to the ice making housing 10 not to rotate beyond a predetermined angle. That is, the first side of the rotational shafts 26 receives rotational force and rotates the tray main body 22 while the second side thereof does not rotate beyond the predetermined angle and supplies rotational force to the tray main body 22.

The ice separating unit 30 is mounted in the ice making housing 10 and separates ice cubes from the ice making tray 20. According to an exemplary embodiment of the present invention, the ice separating unit 30 is connected with the driving unit 70 to supply rotational force thereto. According to an exemplary embodiment of the present invention, the ice separating unit 30 may include one of a lever member having a bar shape and a motor operating by power. For example, the ice separating unit 30 may include one of a lever member manually operating by user's pressure and a motor automatically operating by a switch (not shown).

The overflow preventing member 50 is rotatably coupled to the ice making housing 10 along a lengthwise direction of the ice making tray 20. The overflow preventing member 50 prevents overflow of water accommodated in the ice making tray 20. The overflow preventing member 50 covers the ice generating units 24 depressed from a surface of the ice making tray 20. The overflow preventing member 50 is disposed in a withdrawal direction of the ice accommodator. That is, the overflow preventing member 50 is disposed in an area where the freezing compartment door 9*a* and the ice making housing 10 face the mounting surface.

The overflow preventing member 50 reciprocates by the driving unit 70 between an ice separating position separating ice cubes from the ice generating units 24 of the ice making tray 20 and a cover position covering the ice generating units 24. That is, the overflow preventing member 50 maintains the cover position to cover the ice generating units 24 when the ice making tray 20 accommodates water therein, and rotates oppositely to the ice making tray 20 and moves to the ice separating position opening the ice generating units 24 when ice cubes are separated from the ice making tray 20.

The overflow preventing member 50 includes a preventing member main body 52 to open and close the ice generating units 24 and preventing member rotational shafts 54 provided in opposite sides of the preventing member main body 52. The overflow preventing member 50 is rotatably coupled with the ice making housing 10 to be in parallel with a rotational axis of the ice making tray 20.

According to an exemplary embodiment of the present invention, the preventing member main body 52 is shaped like a plate to cover the ice generating units 24 formed in a lateral side of the ice making tray 20. The preventing member main body 52 reciprocates between the ice separating position and the cover position by the driving unit 70 to open and close the lateral side of the ice making tray 20.

The preventing member rotational shafts 54 are provided in pairs in opposite sides of the preventing member main body 52. The preventing member rotation shafts 54 are rotatably coupled to the ice making housing 10. A lateral side of the preventing member rotational shafts 54 is coupled with the driving unit 70 to supply rotational force to the preventing member main body 52. The preventing member rotational shafts 54 reciprocate by the driving unit 70 between the cover position to cover the ice making tray 20 with the preventing member main body 52, and the ice separating position to open the ice making tray 20.

The driving unit 70 is provided adjacent to the ice making tray 20 and the overflow preventing member 50, and allows the overflow preventing member 50 to reciprocate between the ice separating position to separate ice cubes from the ice generating units 24 and the cover position to cover the ice generating units 24. The driving unit 70 rotates the ice making tray 20 and the overflow preventing member 50 in opposite directions. For example, according to an exemplary embodiment of the present invention, the driving unit 70 rotates the ice making tray 20 clockwise, and accordingly rotates the overflow preventing member 50 counterclockwise. According to an exemplary embodiment of the present invention, the driving unit 70 includes a driving gear 72 provided in a rotational axis of the ice making tray 20, and a driven gear 74 provided in the rotational axis of the overflow preventing member 50 to move together with the driving gear 72. According to an exemplary embodiment of the present invention, the driving unit 70' (refer to FIGS. 9 to 10B) includes a driving pulley 72' (refer to FIGS. 9 to 10B) provided in the rotational axis of the ice making tray 20, a driven pulley 74' (refer to FIGS. 9 to 10B) provided in the rotational axis of the overflow preventing member 50 and a belt 76' (refer to FIGS. 9 to 10B) connecting the driving pulley 72' and the driven pulley 74' and rotating them together.

The ice making tray 20 according to a first exemplary embodiment of the present invention is plurally stacked on the ice making housing 10 while the overflow preventing member 50 corresponds to the plurality of ice making trays 20.

The driving unit 70 is provided in the ice making housing 10 in which the plurality of ice making trays 20 and the plurality of overflow preventing members 50 are coupled to each other. The driving unit 70 includes the driving gear 72 provided in the rotational axis of the ice making tray 20, the driven gear 74 provided in the rotational axis of the overflow preventing member 50 and moving together with the driving gear 72, an ice separating gear 76 disposed at predetermined intervals from the driving gear 72 and a connecting gear 78 provided between the driving gear 72 and the ice separating gear 76.

The driving gear 72 is coupled with the rotational shafts 26 provided in the lateral side of the ice making trays 20. The driving gear 72 is engaged with the driven gear 74 and the connecting gear 78. The driving gear 72 rotates by the operation of the connecting gear 78, and supplies rotational force to the driven gear 74. That is, the driving gear 72 moves the driven gear 74 according to the operation of the connecting gear 78. The ice making trays 20 rotate by the operation of the driving gear 72.

The driven gear 74 is coupled with the preventing member rotational shafts 54 provided in the lateral side of the overflow preventing member 50. The driven gear 74 is connected with the driving gear 72 and the preventing member rotational shafts 54. By the rotation of the driving gear 72, the driven gear 74 rotates in an opposite direction of the rotation direction of the driving gear 72. That is, if the ice making trays 20 rotate by the driving gear 72, the overflow preventing member 50 rotates in an opposite direction of the rotation direction of the ice making trays 20 by the driven gear 74 moving together with the ice making trays 20.

The ice separating gear 76 is disposed at predetermined intervals from the driving gear 72. The ice separating gear 76 is coupled with the ice separating unit 30 and receives power therefrom. The ice separating gear 76 is engaged with the connecting gear 78 disposed between the ice separating gear 76 and the driving gear 72.

The connecting gear 78 is disposed between the driving gear 72 and the ice separating gear 76. A first side of the connecting gear 78 is engaged with the plurality of driving gears 72 while a second side thereof is engaged with the ice separating gear 76. The connecting gear 78 rotates the plurality of driving gears 72 by moving together with the rotation of the ice separating gear 76. According to an exemplary embodiment of the present invention, the connecting gear 78 rotates the driving gear 72 while reciprocating in a transverse direction of the rotational axis of the ice making trays 20 by the rotation of the ice separating gear 76, and allows the overflow preventing member 50 to reciprocate between the ice separating position and the cover position.

For example, the connecting gear 78 moves below the ice making housing 10 if the ice separating gear 76 rotates counterclockwise. According to the movement of the connecting gear 78, the driving gear 72 rotates clockwise and the ice making trays 20 rotate clockwise. The driven gear 74 rotates counterclockwise, and the overflow preventing member 50 rotates counterclockwise to move to the ice separating position.

An elastic member 90 is disposed in the ice separating unit 30. The ice separating unit 30 returns to its original position by the elastic member 90. For example, as the ice separating gear 76 rotates counterclockwise by the operation of the ice separating unit 30, the connecting gear 78, the driving gear 72 and the driven gear 74 rotate together with the ice separating gear 76 to thereby move the overflow preventing member 50 to the ice separating position. Then, the elastic member 90 supplies elastic force to move the overflow preventing member 50 back to the cover position by rotating the ice separating gear 76 clockwise. According to an exemplary embodiment of the present invention, the elastic member 90 is preferably employed in a lever type ice separating unit 30 operated by a user.

Figure 5:
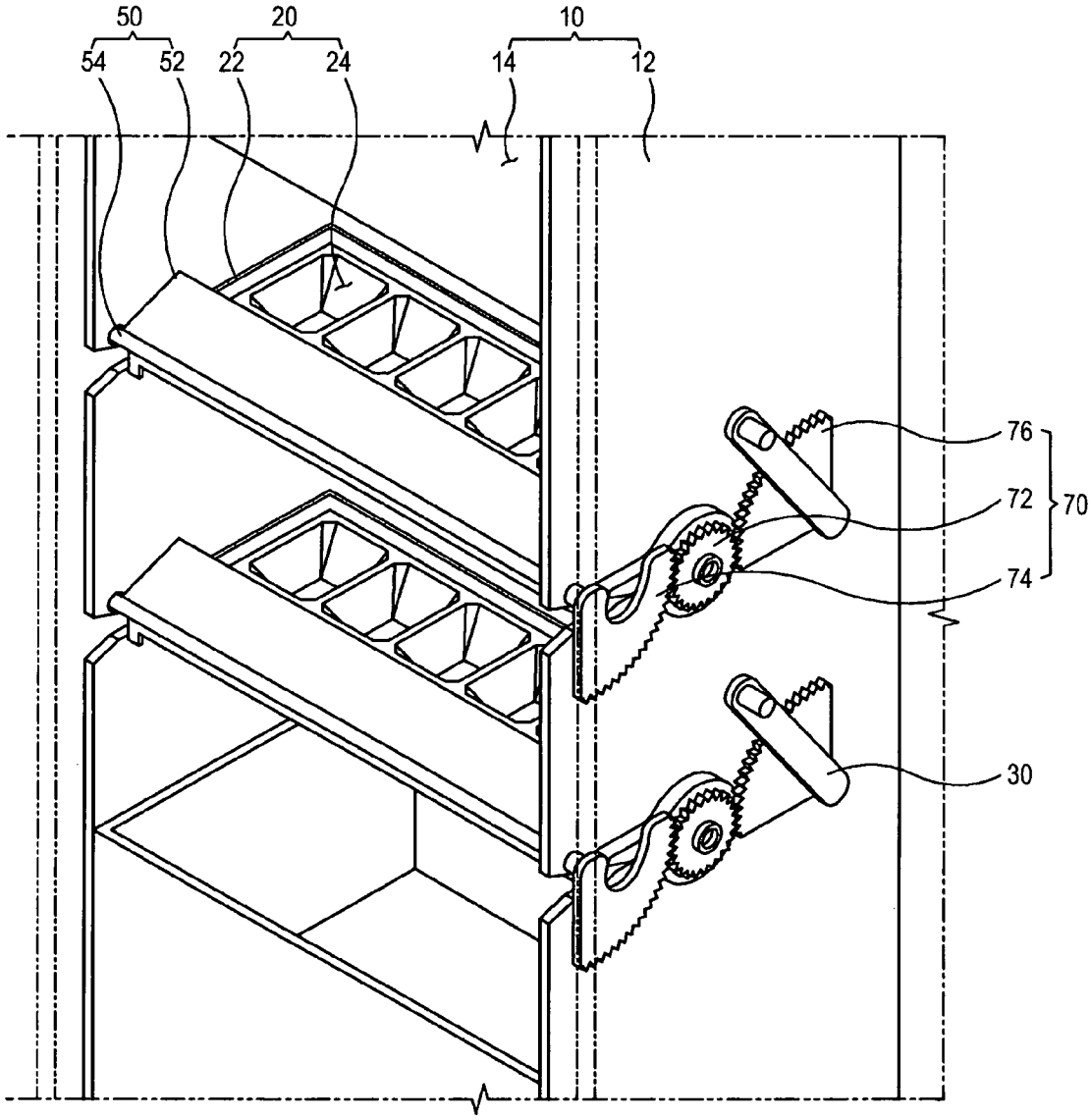
FIG. 5 is a coupling perspective view of a driving unit according to a second exemplary embodiment of the present invention.
Figure 6A:
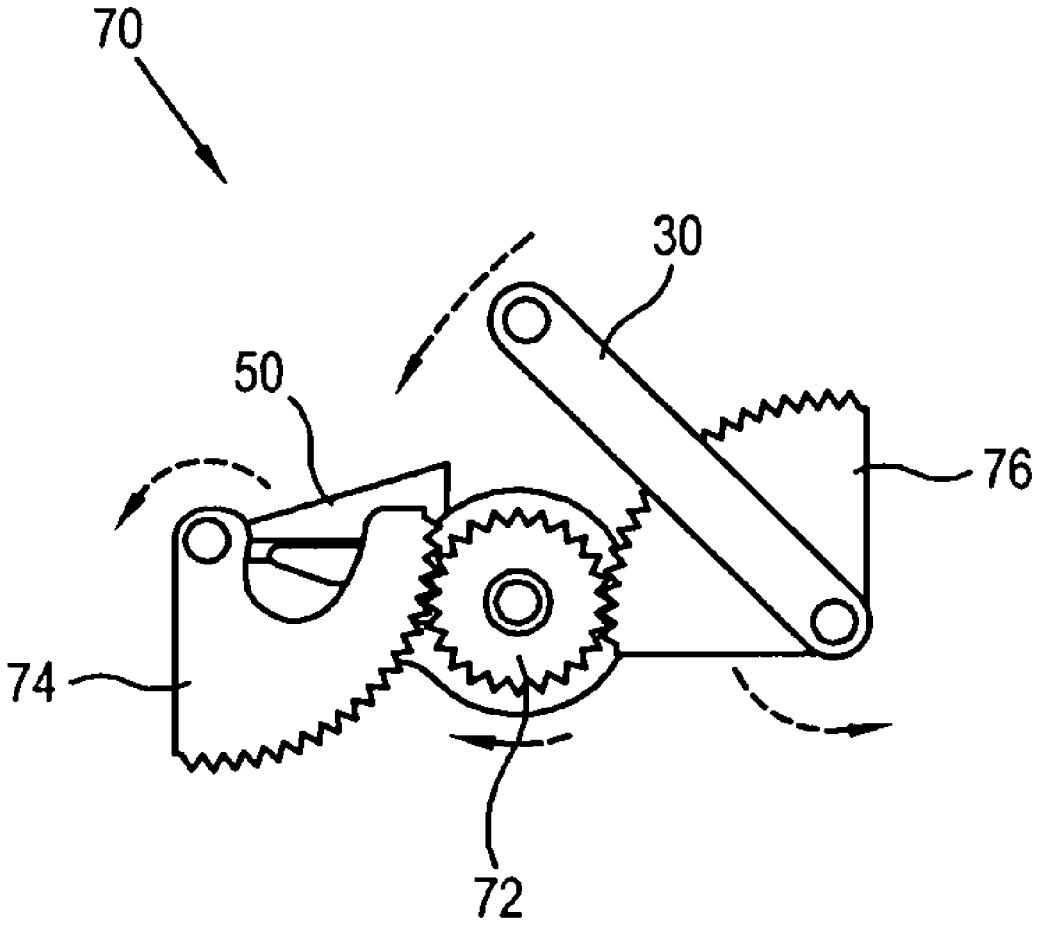
FIG. 6A is a first operational view of the driving unit according to the second exemplary embodiment of the present invention.
Figure 6B:
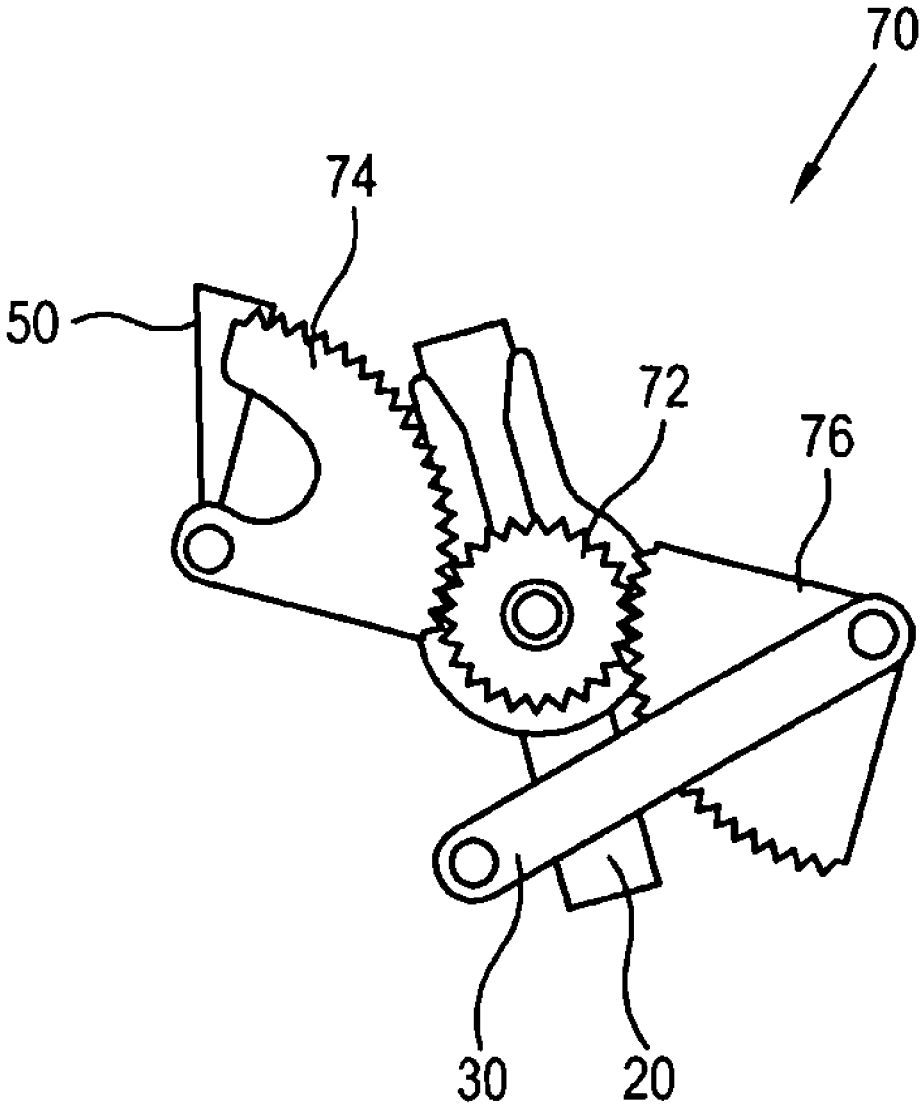
FIG. 6B is a second operational view of the driving unit according to the second exemplary embodiment of the present invention.

Hereinafter, an ice making housing 10, an ice making tray 20, an ice separating unit 30, an overflow preventing member 50 and a driving unit 70 according to a second exemplary embodiment of the present invention will be described with reference to FIGS. 5 to 6B.

The ice making housing 10, the ice making tray 20 and the overflow preventing member 50 are the same as those according to the first exemplary embodiment of the present invention. However, the second exemplary embodiment of the present invention is described focusing on a single ice making tray 20 used. Alternatively, the ice making tray 20 may be plurally used.

The driving unit 70 according to the second exemplary embodiment of the present invention includes a driving gear 72 provided in a rotational axis of the ice making tray 20 and rotating by an operation of the ice separating unit 30, a driven gear 74 provided in a rotational axis of the overflow preventing member 50 and being engaged with the driving gear 72 to move together, and an ice separating gear 76 coupled to the ice separating unit 30 to be engaged with the driving gear 72 and moving together with the driving gear 72 to rotate the driving gear 72 by the ice separating unit 30.

The shape of the driving gear 72, the driven gear 74 and the ice separating gear 76 is the same as that according to the first exemplary embodiment of the present invention, except that the driving gear 72 and the ice separating gear 76 according to the second exemplary embodiment of the present invention are engaged with each other and directly supply rotational force to the driving gear 72 by rotational force of the ice separating gear 76.

Figure 7:
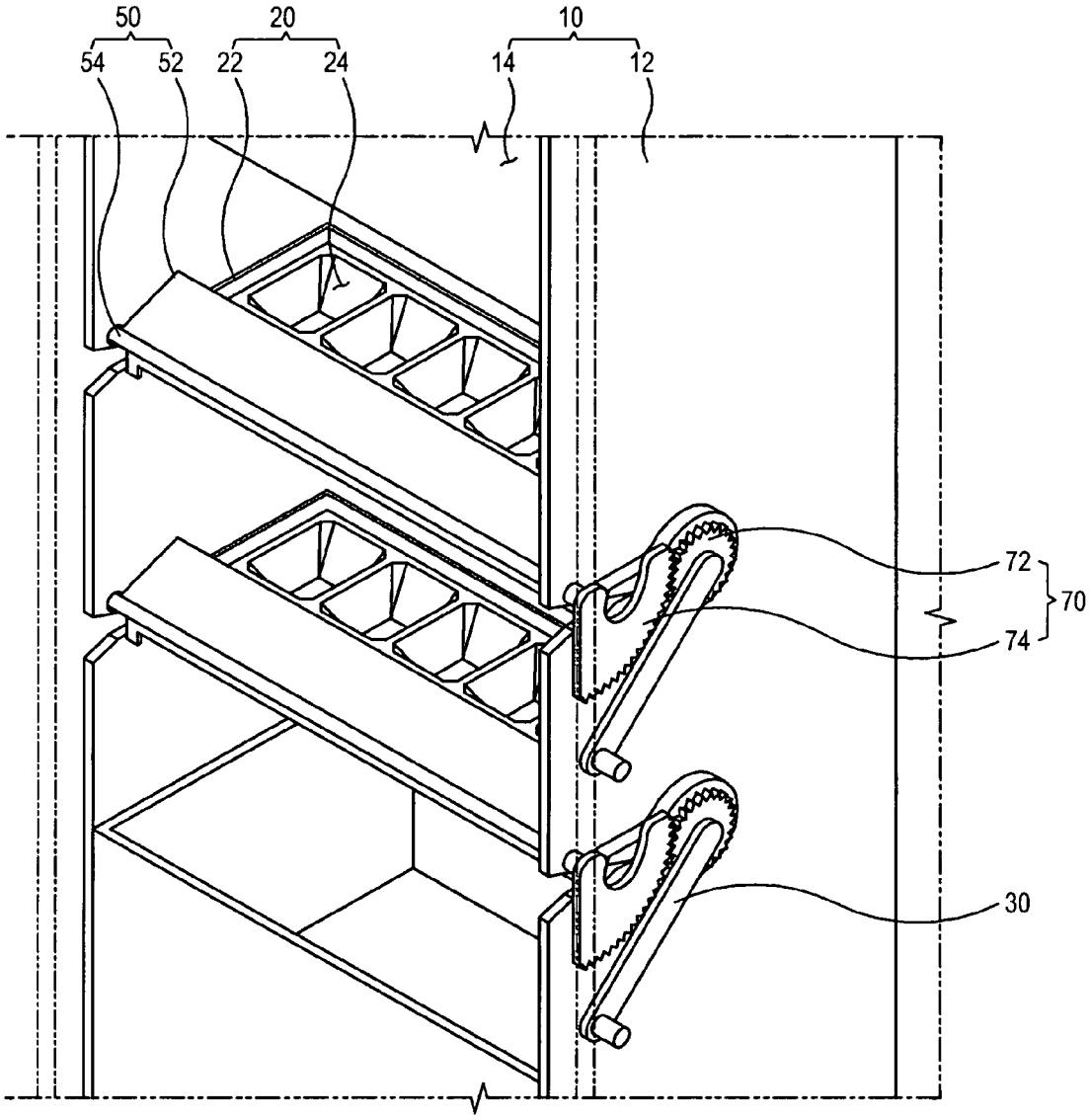
FIG. 7 is a coupling perspective view of a driving unit according to a third exemplary embodiment of the present invention.
Figure 8A:
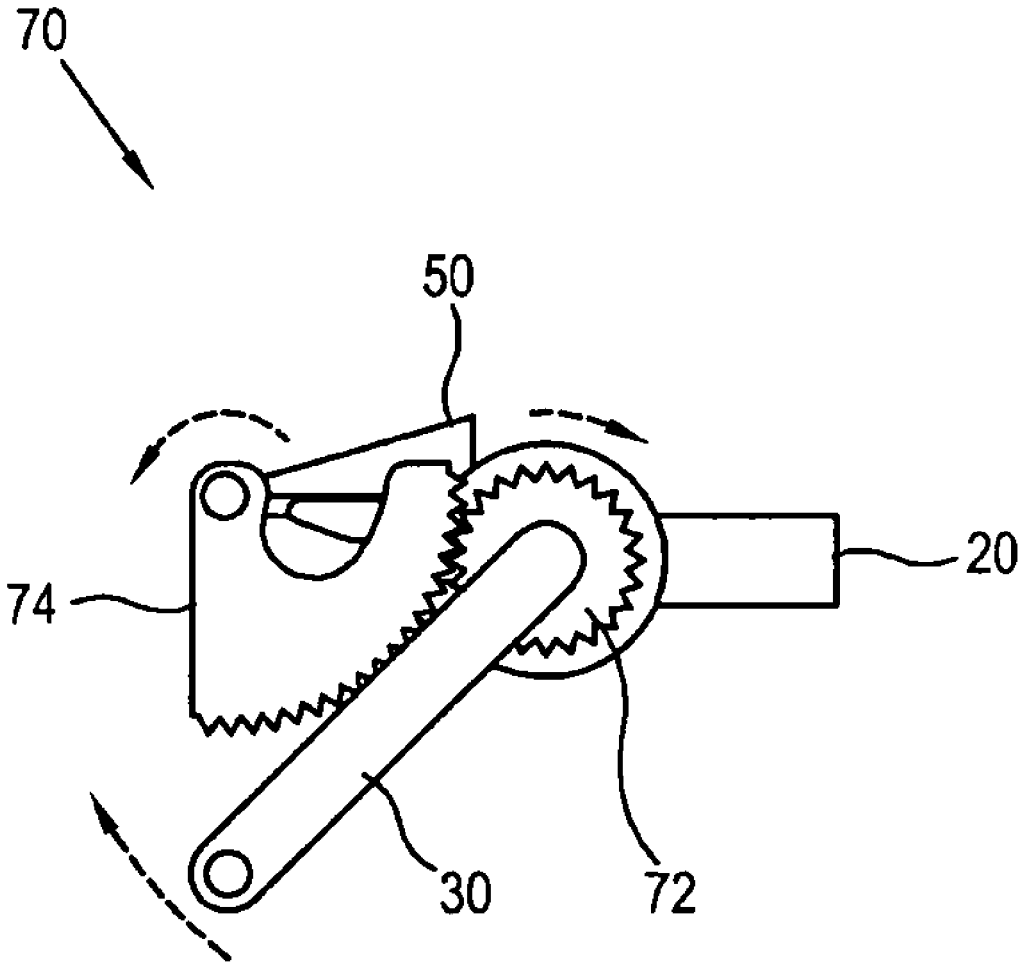
FIG. 8A is a first operational view of the driving unit according to the third exemplary embodiment of the present invention.
Figure 8B:
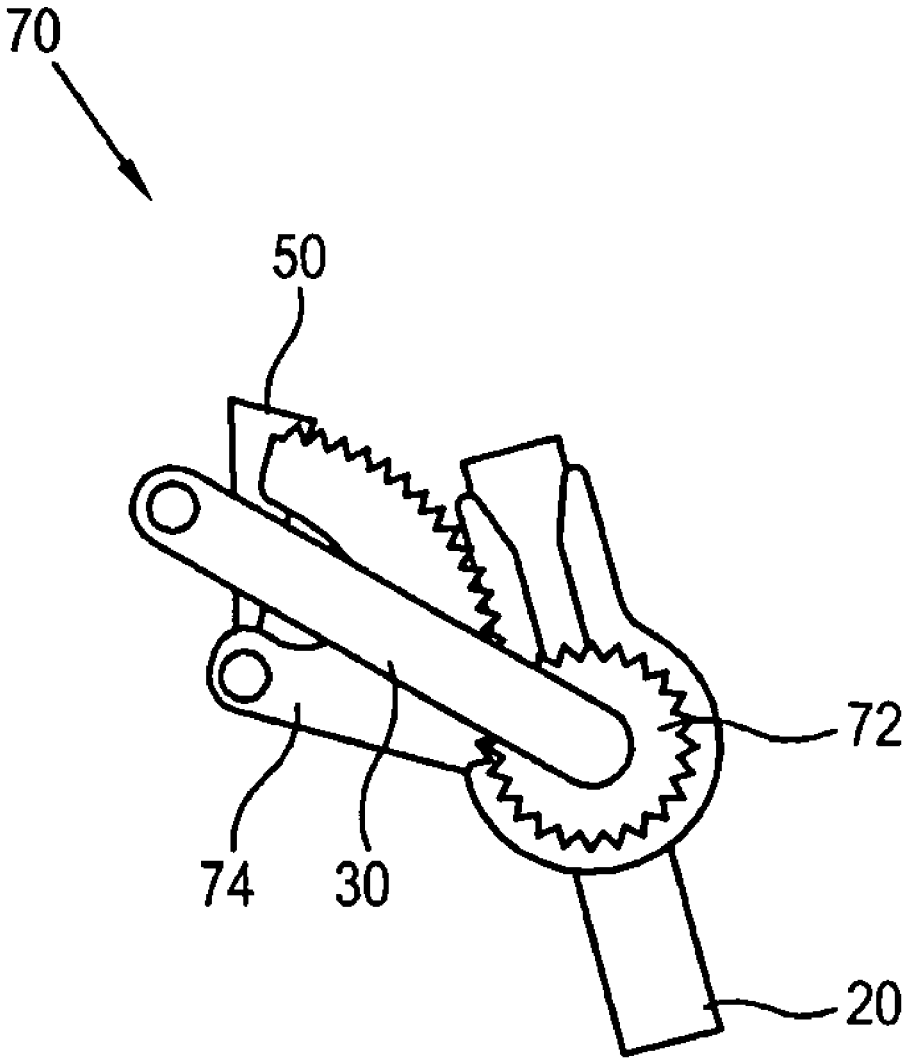
FIG. 8B is a second operational view of the driving unit according to the third exemplary embodiment of the present invention.

Hereinafter, an ice making housing 10, an ice making tray 20, an ice separating unit 30, an overflow preventing member 50 and a driving unit 70 according to a third exemplary embodiment of the present invention will be described with reference to FIGS. 7 to 8B.

The ice making housing 10, the ice making tray 20, the ice separating unit 30 and the overflow preventing member 50 are the same as those according to the first exemplary embodiment of the present invention. However, the third exemplary embodiment of the present invention is described focusing on a single ice making tray 20 used. Alternatively, the ice making tray 20 may be plurally used.

The driving unit 70 according to the third exemplary embodiment of the present invention includes a driving gear 72 provided in a rotational axis of the ice making tray 20 and rotating by an operation of the ice separating unit 30 and a driven gear 74 provided in a rotational axis of the overflow preventing member 50 and being engaged with the driving gear 72 to move together. The ice separating unit 30 is coupled with the driving gear 72.

The shape of the driving gear 72 and the driven gear 74 is the same as that according to the first exemplary embodiment of the present invention, except that the driving gear 72 according to the third exemplary embodiment of the present invention is coupled with the ice separating unit 30 to receive rotational force. That is, the driving gear 72 rotates by the operation of the ice separating unit 30, and accordingly the driven gear 74 rotates.

Figure 9:
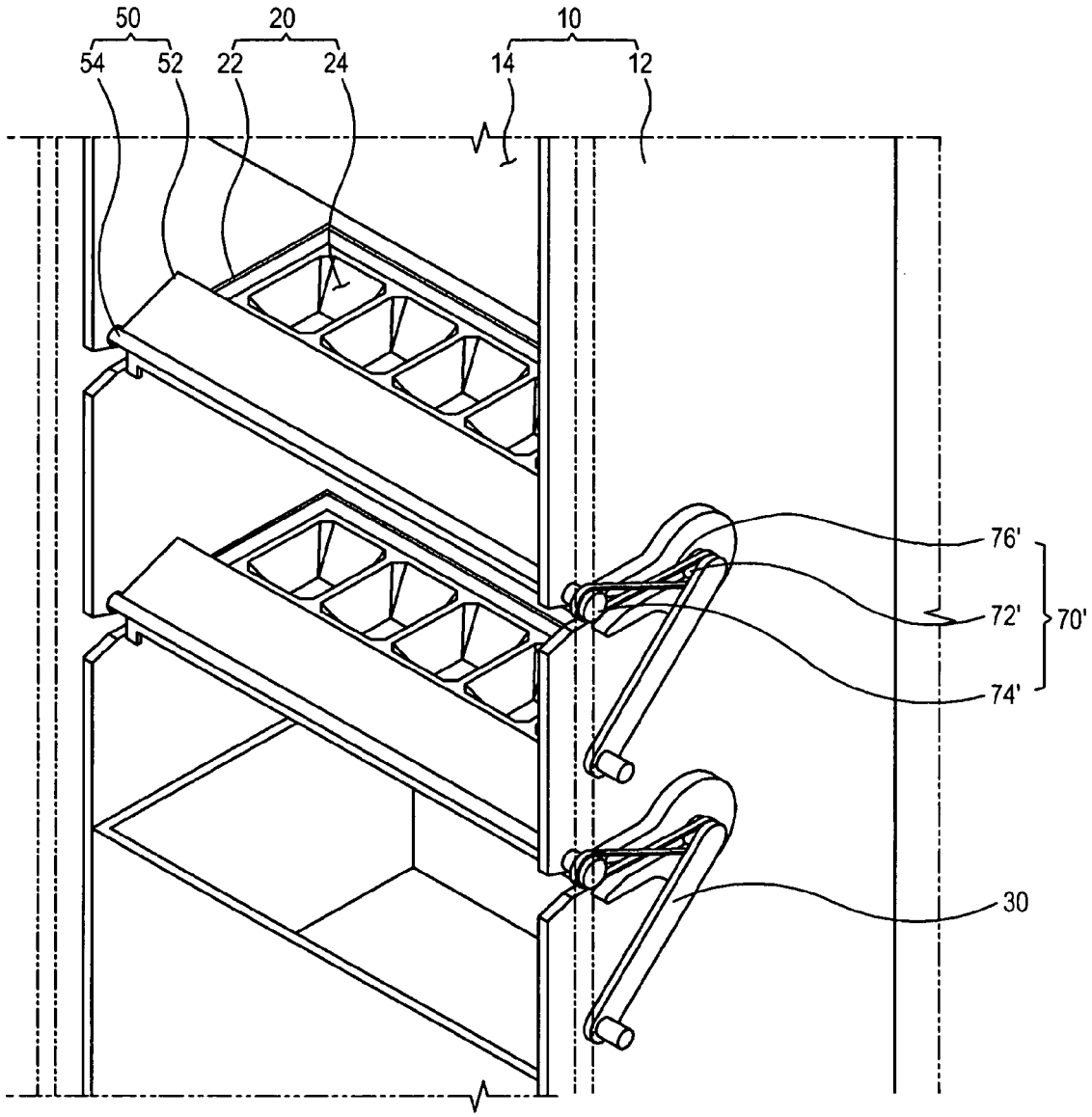
FIG. 9 is a coupling perspective view of a driving unit according to a fourth exemplary embodiment of the present invention.
Figure 10A:
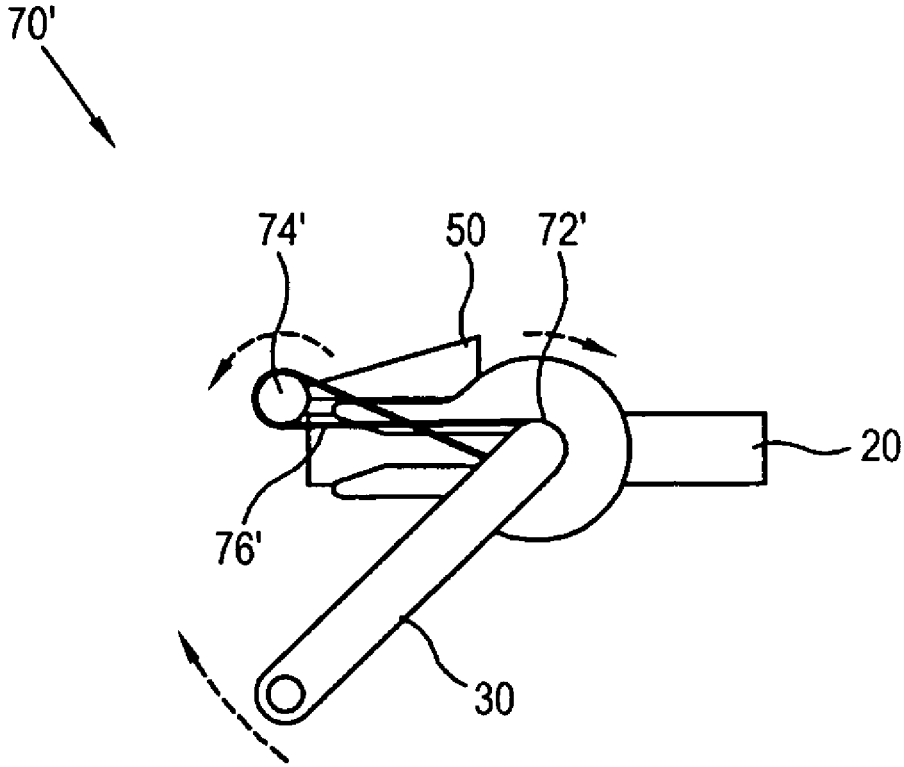
FIG. 10A is a first operational view of the driving unit according to the fourth exemplary embodiment of the present invention.
Figure 10B:
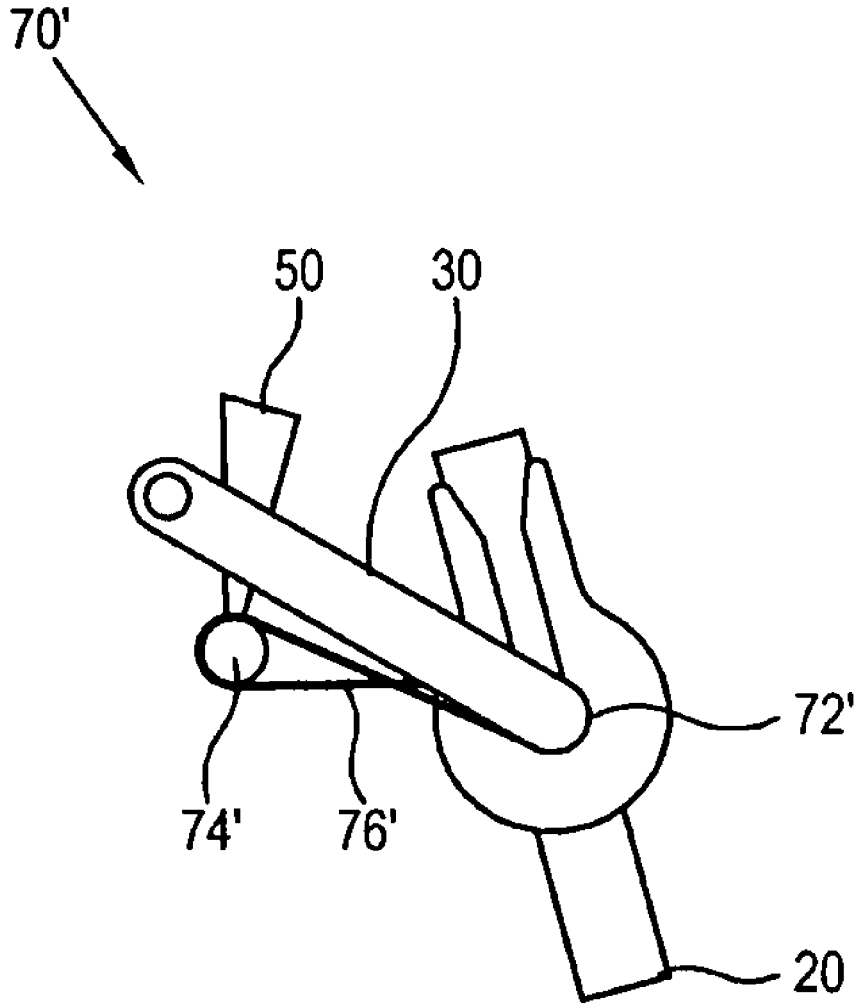
FIG. 10B is a second operational view of the driving unit according to the fourth exemplary embodiment of the present invention.

Hereinafter, an ice making housing 10, an ice making tray 20, an ice separating unit 30, an overflow preventing member 50 and a driving unit 70' according to a fourth exemplary embodiment of the present invention will be described with reference to FIGS. 9 to 10B.

The ice making housing 10, the ice making tray 20, the ice separating unit 30 and the overflow preventing member 50 are the same as those according to the first exemplary embodiment of the present invention. However, the fourth exemplary embodiment of the present invention is described focusing on a single ice making tray 20 used. Alternatively, the ice making tray 20 may be plurally used.

The driving unit 70' according to the fourth exemplary embodiment of the present invention includes a driving pulley 72' provided in a rotational axis of the ice making tray 20 and rotating by an operation of the ice separating unit 30, a driven pulley 74' rotatably provided in a rotational axis of the overflow preventing member 50 and a belt 76' crossedly connecting the driving pulley 72' and the driven pulley 74' and rotating the driving pulley 72' and the driven pulley 74'. Here, the driving pulley 72' is coupled with the ice separating unit 30.

Like in the first exemplary embodiment, an elastic member 90 is provided according to the second to fourth exemplary embodiments of the present invention if the lever type ice separating unit 30 is employed.

With the foregoing configuration, an assembling process and an operation of the ice making housing 10, the ice making tray 20, the ice separating unit 30, the overflow preventing member 50 and the driving unit 70 mounted in the refrigerator 1 according to the first to fourth exemplary embodiments of the present invention will be described.

Since the assembling process according to the first to fourth exemplary embodiments of the present invention is similar, the assembling process according to the first exemplary embodiment will be described as a representative. The driving unit 70 according to the first to third exemplary embodiments of the present invention is similar, and the operation according to the first exemplary embodiment will be described as a representative. The operation according to the fourth exemplary embodiment is different from those according to the first to third exemplary embodiment, and will be described in brief.

The plurality of ice making trays 10 is stacked on the ice making chamber 14 of the ice making housing 10. The driving gears 72 are mounted in the rotational shafts 26 of the plurality of ice making trays 20. The overflow preventing member 50 is rotatably coupled to the ice making housing 10 to cover the lateral side of the ice making trays 20. The driven gear 74 is mounted on the lateral side of the overflow preventing member 50, i.e., on the preventing member rotational shaft 54 to be engaged with the driving gears 72.

The ice separating unit 30 and the ice separating gear 76 coupled to the ice separating unit 30 are mounted in the ice making housing 10. The elastic member 90 is disposed in the ice separating unit 30 to supply rotational force. The elastic member 90 is employed only when a lever type ice separating unit 30 is mounted. The elastic member 90 is not employed if a motor type ice separating unit (not shown) is mounted. The connecting gear 78 is disposed between the plurality of driving gears 72 and the ice separating gear 76 to be engaged therewith.

In the operation according to the first exemplary embodiment of the present invention, water is supplied to the ice generating units 24 of the ice making trays 20 to generate ice cubes. The freezing compartment 5*a* is closed by the freezing compartment door 9*a*. Even if the freezing compartment door 9*a* is open and closed while the water accommodated in the ice making tray 20 is not frozen completely, the water accommodated in the ice making trays 20 does not overflow by the overflow preventing member 50.

If the ice separating unit 30 operates after the water in the ice making trays 20 is frozen, the ice separating gear 76 rotates counterclockwise and the connecting gear 78 moves together with the rotation of the ice separating gear 76 below the ice making housing 10.

If the connecting gear 78 moves below, the plurality of driving gears 72 engaged with the connecting gear 78 rotates clockwise and allows the ice making trays 20 to torsion-rotate and separate ice cubes therefrom. The driven gear 74 rotates counterclockwise by the rotation of the driving gear 72, and the overflow preventing member 50 rotates to the ice separating position to prevent cross interference between the ice making trays 20 and the overflow preventing member 50.

If driving force supplied to the ice separating unit 30 is removed after the ice separating operation of the ice making trays 20, the overflow preventing member 50 rotates to the cover position covering the ice making trays 20 by the elastic member 90.

In the operation according to the fourth exemplary embodiment of the present invention, if water accommodated in the ice making trays 20 is completely frozen, the ice making unit 30 operates. Then, the driving pulley 72' rotates clockwise and the driven pulley 74' rotates counterclockwise by the belt 76'. That is, the ice making trays 20 rotate clockwise while the overflow preventing member 50 rotates counterclockwise.

If the refrigerator 1 according to the first to fourth exemplary embodiments of the present invention includes the lever type ice separating unit, the elastic member is provided to supply rotational force and rotate the overflow preventing member from the ice separating position to the cover position.

Meanwhile, if the refrigerator according to the first to fourth exemplary embodiments of the present invention includes the motor type ice separating unit, the elastic member is not provided since a rotation shaft of the motor rotates clockwise and counterclockwise.

As described above, a refrigerator according to the present invention prevents overflow of water accommodated in an ice making tray, prevents cross interference between the ice making tray and an overflow preventing member in an ice separating operation of the ice making tray by rotating the ice making tray and the overflow preventing member in opposite directions, prevents deformation of the ice making tray and separates ice cubes from the ice making tray without difficulty to thereby improve credibility.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A refrigerator having a main body cabinet including a storage compartment and a door coupled to the main body cabinet to open and close the storage compartment, the refrigerator comprising:

an ice making housing mounted in the door forming an ice making chamber;

an ice making tray having a rotational shaft rotatably accommodated in the ice making housing;

an ice generating unit to freeze water supplied to the ice making tray;

an ice separating unit which is mounted in the ice making housing and separates ice cubes from the ice making tray;

an overflow preventing member which is rotatably coupled directly to the ice making housing along a lengthwise direction of the ice making tray and prevents overflow of water accommodated in the ice making tray; and a driving unit which is provided adjacent to the ice making tray and the overflow preventing member and allows the overflow preventing member to reciprocate between an ice separating position separating ice cubes from the ice generating unit and a cover position covering the ice generating unit, wherein the driving unit comprises a driving gear which is provided in the rotational axis of the ice making tray and rotates by the operation of the ice separating unit, and a driven gear which is provided in a rotational axis of the overflow preventing member and engaged with the driving gear to rotate together, and wherein the driving gear and the driven gear of the driving unit simultaneously rotate the ice making tray and the overflow preventing member in opposite directions to each other, respectively, whereby the ice making tray and the overflow preventing member are always concurrently in motion or stopped.

2. The refrigerator according to claim 1, wherein the overflow preventing member is rotatably coupled with the ice making housing to be in parallel with a rotational axis of the ice making tray.

3. The refrigerator according to claim 1, wherein the ice making tray comprises a plurality of ice making trays, each of the ice making trays being stacked in the ice making housing and including an overflow preventing member corresponding to each of the plurality of ice making trays.

4. The refrigerator according to claim 3, wherein the driving unit further comprises an ice separating gear which is rotatably coupled with the ice separating unit and disposed at predetermined intervals from a plurality of driving gears provided adjacent to the plurality of ice making trays, and a connecting gear, a first side of which is engaged with the plurality of driving gears and a second side of which is engaged with the ice separating gear to move together with the rotation of the ice separating gear and rotate the plurality of driving gears.

5. The refrigerator according to claim 4, wherein the connecting gear reciprocates in a transverse direction of the rotational axis of the ice making tray by the rotation of the ice separating gear.

6. The refrigerator according to claim 1, wherein the driving unit further comprises an ice separating gear which is coupled with the ice separating unit to be engaged with the driving gear and moves together with the driving gear to rotate the driving gear by the ice separating unit.

7. The refrigerator according to claim 1, wherein the ice separating unit is coupled with the driving gear and supplies rotational force to the driving gear.

8. The refrigerator according to claim 1, wherein the driving unit comprises a driving pulley which is provided in the rotational axis of the ice making tray and rotates by the operation of the ice separating unit;

a driven pulley which is rotatably provided in a rotational axis of the overflow preventing member; and a belt which crossedly connects the driving pulley and the driven pulley and rotates the driving and driven pulleys.

9. The refrigerator according to claim 1, further comprising an elastic member which is provided in the ice separating unit and supplies elastic force to move the overflow preventing member from the ice separating position to the cover position.

10. The refrigerator according to claim 9, wherein the ice separating unit comprises a lever member which is shaped like a bar.

11. The refrigerator according to claim 1, wherein the ice separating unit comprises a motor.

12. A refrigerator which has a storage compartment, and a door to open and close the storage compartment, the refrigerator comprising:

an ice making housing mounted on the door;

a plurality of ice making trays stacked in the ice making housing;

a plurality of overflow preventing members corresponding to the plurality of ice making trays, each overflow preventing member being rotatably coupled directly to the ice making housing along a lengthwise direction of one of the plurality of ice making trays and preventing overflow of water accommodated in the plurality of ice making trays; and a plurality of driving units which are provided at each of the overflow preventing members and allow the overflow preventing members to reciprocate between an ice separating position separating ice cubes from the ice generating unit and a cover position covering the ice generating unit, wherein each of the driving units comprises a driving gear which is provided on a rotational axis of the ice making tray and a driven gear which is provided on a rotational axis of the over flow preventing member and engaged with the driving gear to rotate together, and wherein the driving gear and the driven gear of the driving unit simultaneously rotate the ice making tray and the overflow preventing member in opposite directions to each other, respectively, whereby the ice making tray and the overflow preventing member are always concurrently in motion or stopped.

13. The refrigerator according to claim 12, wherein each of the driving units further comprises:

an ice separating gear which is disposed at predetermined intervals from the plurality of driving gears provided in the plurality of ice making trays, and a connecting gear a first side of which is engaged with the plurality of driving gears and a second side of which is engaged with the ice separating gear to move together with the rotation of the ice separating gear and rotate the plurality of driving gears.

* * * * *